US005465747A

United States Patent [19]

de Almeida

[11] Patent Number: 5,465,747

[45] Date of Patent: Nov. 14, 1995

[54] PRESSURE VALVE ASSEMBLY FOR USE IN GAS-LIFT PRODUCING OIL-WELLS

[75] Inventor: Alcino R. de Almeida, Rio de Janeiro, Brazil

[73] Assignee: Petroleo Brasileiro S.A.-Petrobras, Rio de Janeiro, Brazil

[21] Appl. No.: 186,474

[22] Filed: Jan. 26, 1994

[30] Foreign Application Priority Data

Jan. 27, 1993 [BR] Brazil ..... 9300293

[51] Int. Cl.[6] ..... F04F 1/08

[52] U.S. Cl. ..... 137/155; 166/319

[58] Field of Search ..... 137/155; 251/326, 251/328, 329; 417/109; 166/373, 316, 319

[56] References Cited

U.S. PATENT DOCUMENTS

| | | | |
|---|---|---|---|
| 989,441 | 4/1911 | Suits et al. | 251/328 X |
| 3,028,815 | 4/1962 | Canalizo | 417/109 X |
| 3,131,644 | 5/1964 | Vincent | 137/155 X |
| 3,363,581 | 1/1968 | Kelley et al. | 137/155 X |
| 4,512,155 | 4/1985 | Sheinbaum | 417/109 X |

*Primary Examiner*—Martin P. Schwadron
*Assistant Examiner*—Kevin L. Lee
*Attorney, Agent, or Firm*—Sughrue, Mion, Zinn, Macpeak & Seas

[57] ABSTRACT

A pressure valve assembly for use in gas-lift producing oil-wells includes a cylindrical body, a first pressure chamber including bellows located in the body, a second pressure chamber in the body having a first port for communication with gas pressure in a lining or casing, a second port for communicating the second chamber with a pipe in the lining, a valve stem connected to the bellows for movement in the second chamber and a gate valve assembly connected to the stem in the second chamber for controlling the gas flow between the first and second ports.

2 Claims, 6 Drawing Sheets

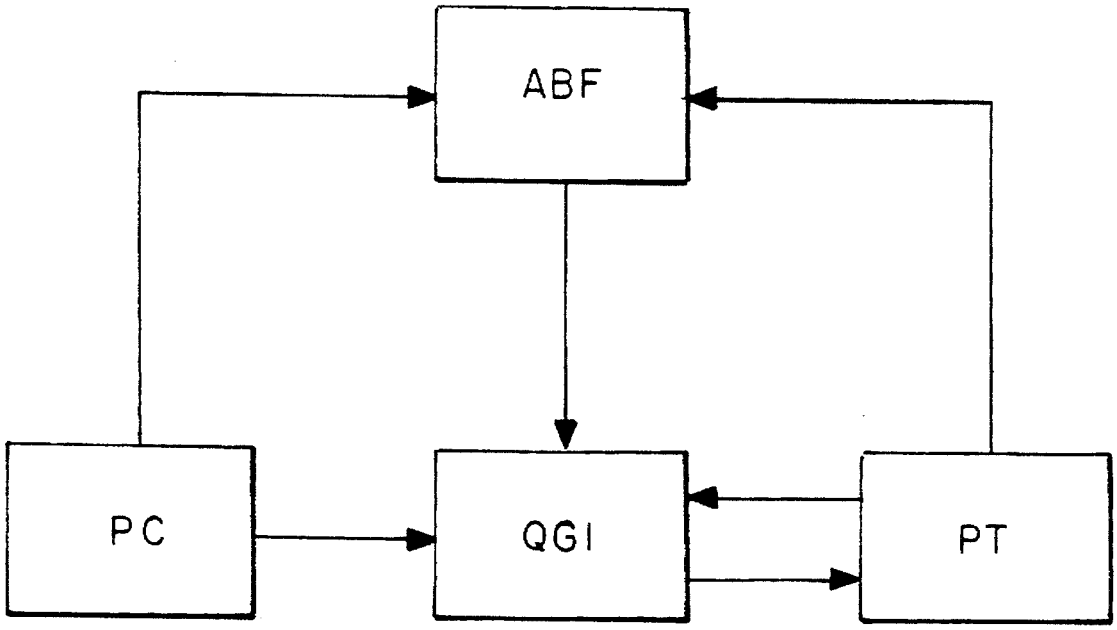
FIG.5
FIG.6
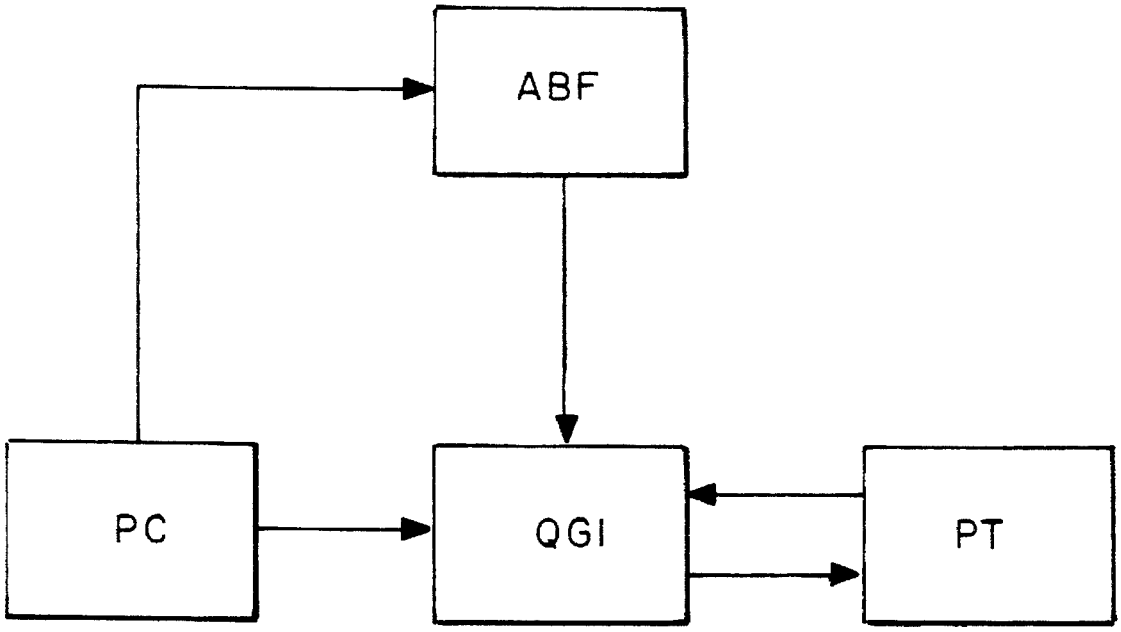

PRESSURE VALVE ASSEMBLY FOR USE IN GAS-LIFT PRODUCING OIL-WELLS

BACKGROUND OF THE INVENTION

The invention is of an improved kind of pressure valve meant for oil wells producing by gas lift.

At wells equipped to produce by means of gas lift, valves known as "pressure valves", also "calibrated valves" or also, "charged bellows valves" are usually employed. In wells where continous gas lift is employed such valves are generally used to start up a well, that is, to start up production again after it has been stopped for some reason. Where gas lift is intermittent this kind of valve is also used for regular working of a well.

Lately, however, these valves have been used for satellite wells producing by continuous gas lift. At such wells any break in operation is extremely expensive and therefore avoided to the utmost. Therefore the production string lowered with the valves is meant to operate for a relatively long time, which means that the point at which gas has to be injected will be a different one as time goes by. Hence, neither a pressure valve can be used just for start-up nor an "aperture valve" for regular operation, as usually happens where the wells are of the continuous gas lift sort. Pressure valves have to be used.

Pressure valves were suitable for the first two major applications therewith (start-up for continuous gas lift well and start-up as well as regular operations for intermittent gas lift wells). However they are not suitable for satellite wells.

Much study has been undertaken concerning the behaviour in action of these valves for this became important to know in the designing of continous gas lift wells, where such valves are used for regular operation. However such study is complicated and so far full mastery over behaviour has not yet been achieved, in spite of exhaustive experimental surveys undertaken throughout the world.

It seems pretty obvious to us that it is unlikely that such knowledge will be forthcoming in the near future at the rate such usual kind of approaches are taking place. Thus since we have not been able to well determine the behaviour of this kind of valve in operation it seems reasonable that the best approach is to develop a valve with the desired behaviour.

SUMMARY OF THE INVENTION

The invention herewith proposed has regard for such fact. In developing the invention the major concern displayed has been to change as little as possible of the usual shape of the valve. Any valve internally altered which failed to make use of the features of existing models thereof would be very difficult to go ahead with since the whole manufacturing and maintenance framework for the existing valves would be foregone.

Hence it is intended under this invention to alter the end of valve stem seat while keeping the rest of the valve unchanged. Afterwards, when the valve has been tested, other changes for valve operating purposes may be called for, however the overall structure of the valve should remain as it was.

BRIEF DESCRIPTION OF THE DRAWINGS

The improved pressure valve herewith invented will now be described in greater details with the help of the drawings that are part of this specification:

FIG. 5 is a block diagram for FIG. 1 valve;

FIG. 6 is a block diagram for improved pressure valve;

DETAILED DESCRIPTION OF THE INVENTION

Figure 1:
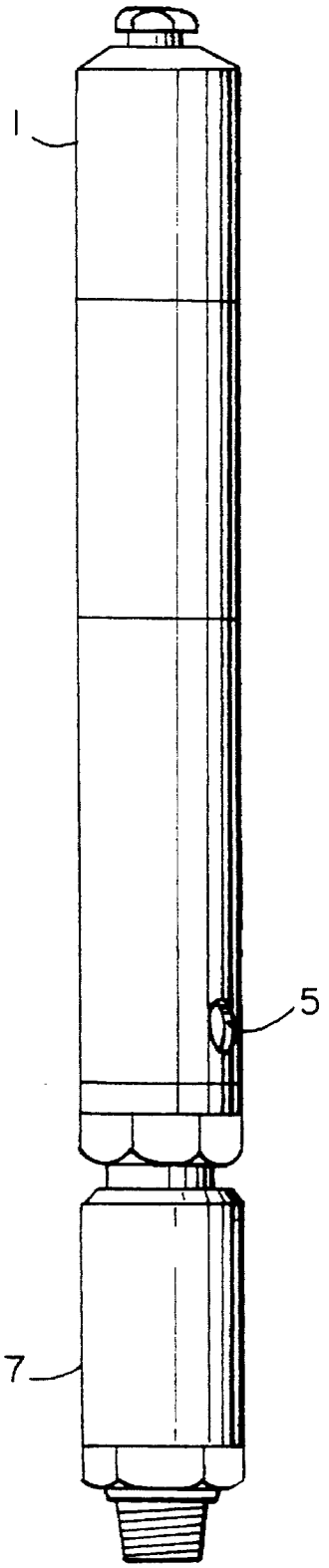
FIG. 1 PRIOR ART
FIG. 1 is a front view of a known kind of charged bellows valve.
Figure 2:
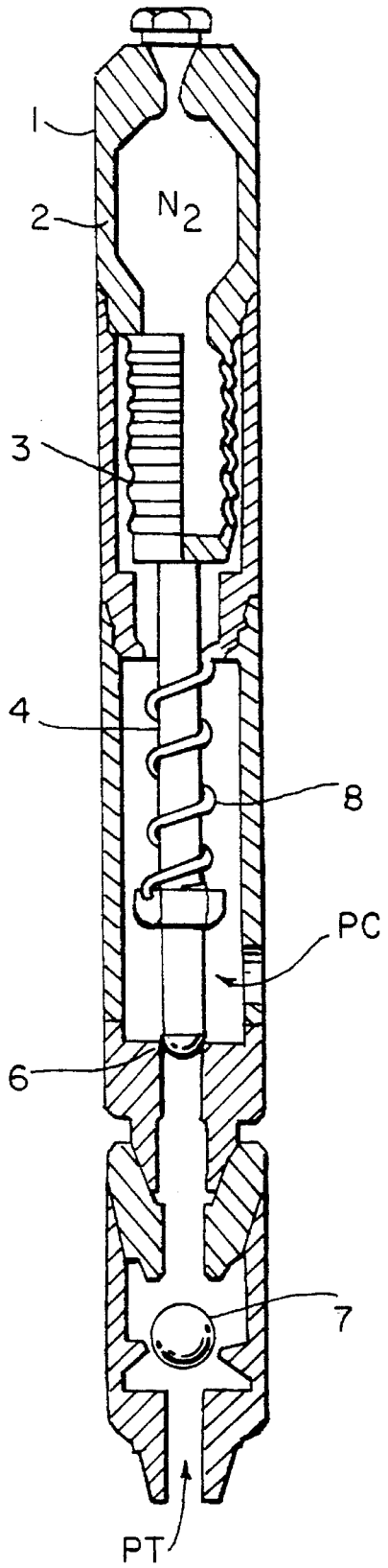
FIG. 2 PRIOR ART
FIG. 2 is a section view of the charged bellows valve referred to in FIG. 1.

FIG. 1 and 2 show general arrangement of the usual kind of pressure valve, so-called "lining operated". Such arrangement of the various kinds of such valves sold may vary slightly, however major parts thereof are the following: a cylindrical body 1, a dome 2, bellows 3, stem 4, ports 5, for incoming gas, seat 6 and check valve 7. Stem 4 may be with or without spring 8, end of which serves to seal off seat 6.

Figure 3:
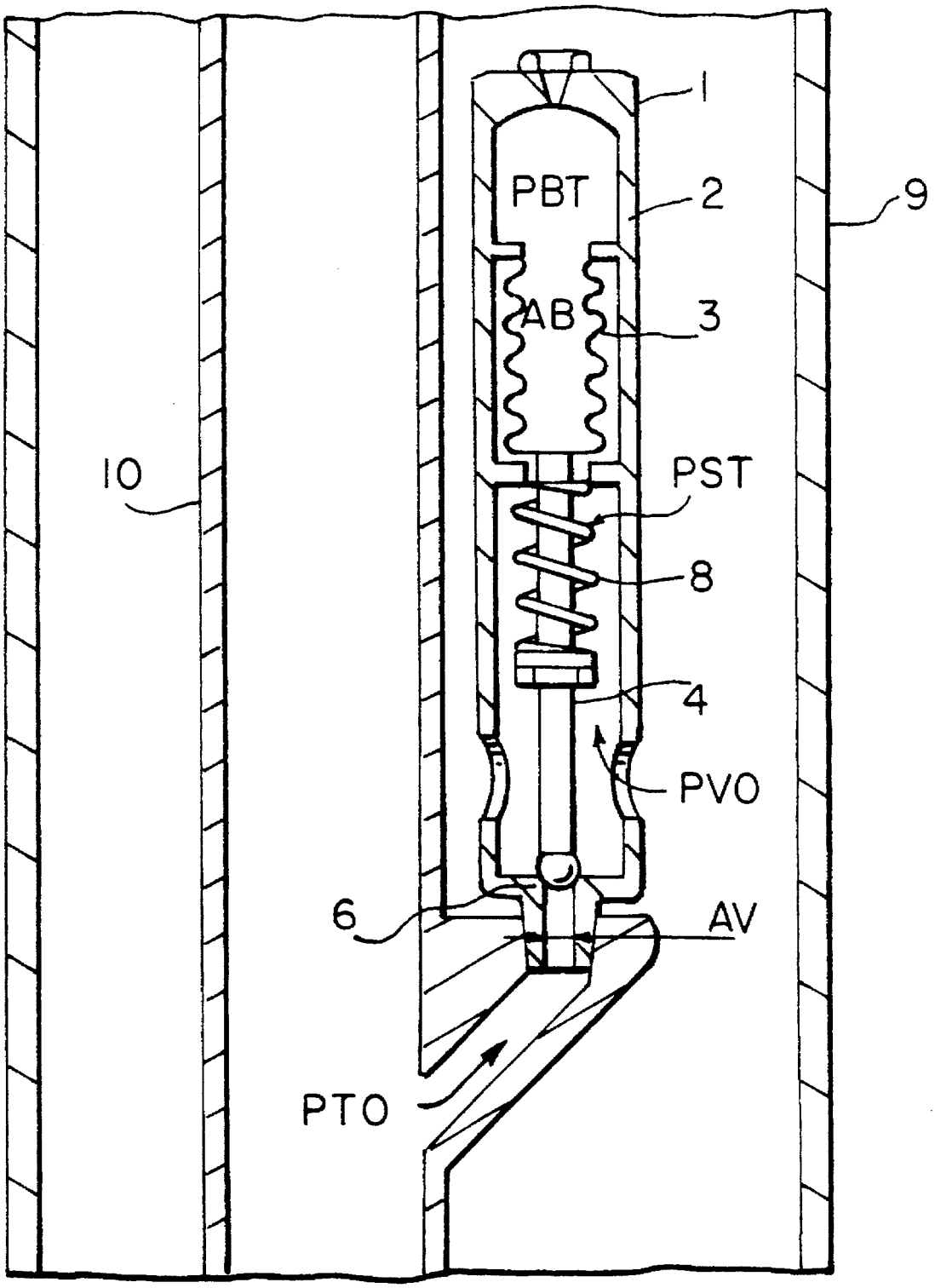
FIG. 3 is a front view showing the FIG. 1 valve about to open.

In order to know how and when the valve ought to open, the balance of forces acting at the point at which the valve lies in the well has to be worked out. Let us look at FIG. 3 which shows the valve when it is about to open. Dome 2 is charged with gas (usually nitrogen) at a pressure PBT. Areas of bellows 3 and seat 6 are AB and AV respectively. Within such areas pressures PBT, PVO (pressure in lining 9 at time of opening), PTO (pressure in pipe 10 at that same moment) and PST (tension due to spring 8) are acting. Thus, it is easy to equate this as:

(Forces that tend to open)=(forces that tend to close)

$$PVO\cdot(AB-AV)+PTO\cdot AV=PBT\cdot AB+PST\cdot(AB-AV) \quad (1)$$

By dividing equation (1) by AB, we have:

$$PVO\cdot(1-(AV/AB))+PTO\cdot(AV/AB)=PBT+PST\cdot(1-(AV/AB)) \quad (2)$$

Calling AV/AB=R (ratio of areas: bellows/seat) we end up with an equation governing the opening of the valve:

$$PVO\cdot(1-R)+PTO\cdot R=PBT+PST\cdot(1-R) \quad (3)$$

Valves generally used have no spring 8 so that PST=0 in equation (3), which means that:

$$PVO\cdot(1-R)+PTO\cdot R=PBT \quad (4)$$

Equation (4) shows that pressure in pipe 10 affects valve opening in proportion to R=AV/AB. This ratio may vary by about 0.07 to about 0.25 (from smallest to biggest seat) for commercial valves so far used. That is, pressure of pipe may account for about 25% of force needed to open valve under given conditions. Even so this kind of valve is known in current technical literature as a "lining-operated valve", which is obviously a misnomer, since the part played by pressure in the pipe is most often significant.

When gas lift is continuous such effect is merely tolerable, for it is partly responsible for interference (that is, injection in more than one valve) and makes control difficult, since pressure into the pipe is a rarely known data with any degree of precision.

Figure 4:
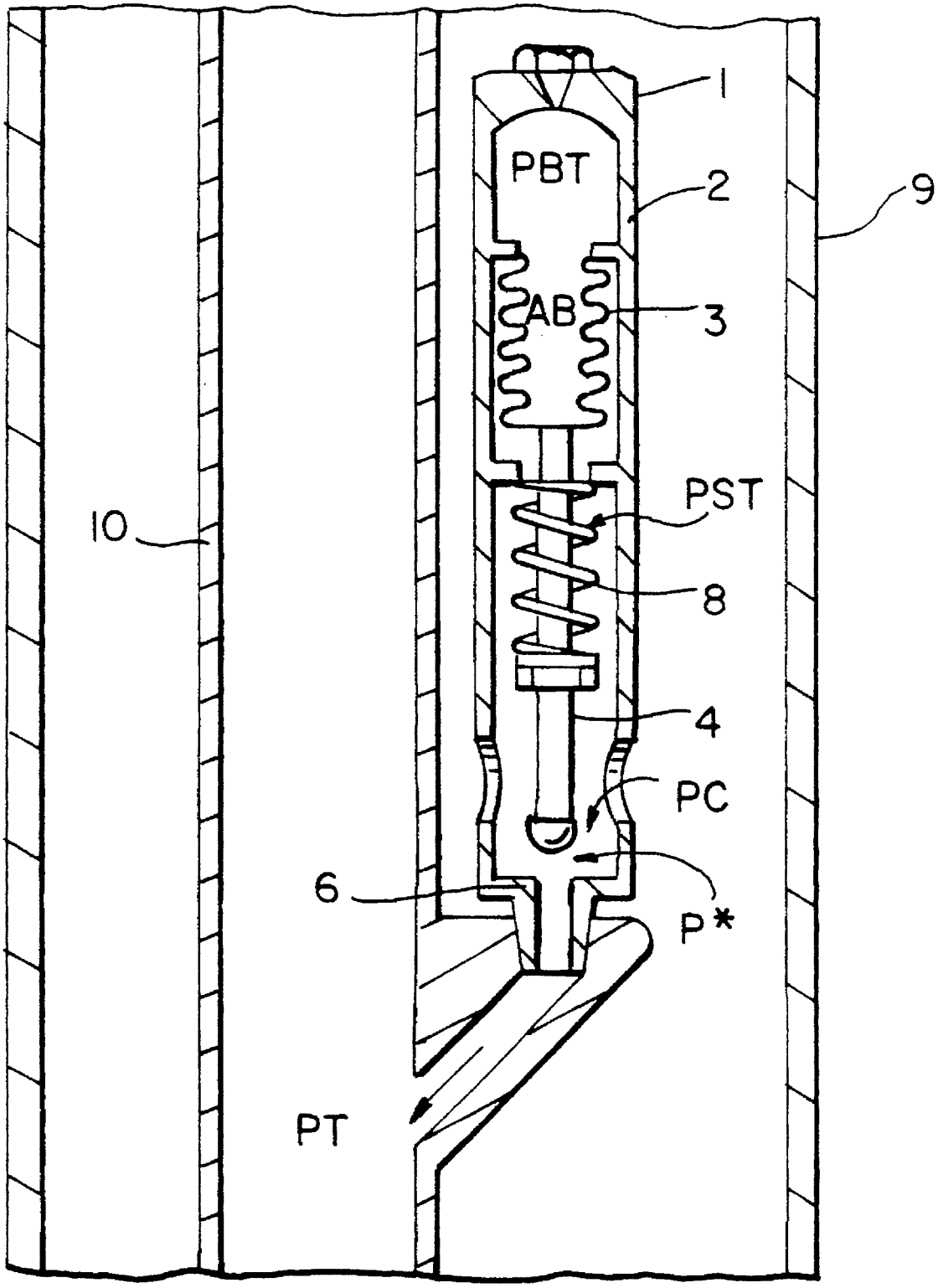
FIG. 4 is a front view of FIG. 1 valve open.

When the valve is open, however, that is when it is unsuitable for continuous gas lift purposes. Let us look at FIG. 4. As shown there, the valve is open which allows gas from lining 9 to flow into pipe 10 at a rate of flow QGI. If we try to arrive at the same balance of forces as before for opening of the valve (equation 1), we shall find that:

(i) PC lining pressure continues to act upon area (AB–AV);

(ii) PST spring pressure (equivalent) continues to act in the same way upon the same area (assuming the spring obeying Hooke's law);

(iii) PBT bellows pressure should rise due to drop in bellows-dome volume, brought about by stem movement; and (iv) pressure acting upon stem end is not necessarily that in the pipe but rather $P^{++}$, where $PT \leqq P^{++} \leqq PC$. This is because stem serves to restrict flow and creates localized turbulences. Actually, $P^{++}$ is merely an average mathematical figure brought about by the various pressures that act around the end of stem 4. $P^{++}$ will equal PT when valve is closed and equal PC when valve is fully open, with stem 4 well withdrawn, therefore affecting flow very slightly.

Changes in dome pressure PBT even though small are harmful, however, worse than it is the action of intermediate pressure $P^{++}$ supposedly unknown, upon the end of stem 4. Such pressure affects size of valve opening (by about 7% and by about 25% as referred to previously). Since $P^{++}$ is a function of PC and PT, pressure in pipe PT affects the degree of valve opening.

FIG. 5 block diagram shows this effect. Choosing one pair PT, PC there will be a corresponding opening and a flow of gas QGI, representing area open to such flow ABF.

Pressure of lining is controlled at surface level, but pipe pressure within the pipe is the outcome of the two-phase flow phenomenon which takes places inside a pipe which, in turn, is affected by the flow of the gas QGI itself.

FIG. 5 serves to show that control of continuous gas lift with this type of valve becomes extremely complicated. This is so because there is only one variable that can be controlled, which is the pressure of the lining, and which acts not only upon the opening of the valve but also upon the flow of gas. The ideal thing would be to have one more sign or variable that could be controlled that might by itself control the opening of the valve.

However a great step forward would be to do away with the effect of pressure within the pipe upon the area open to flow, as shown in FIG. 6. In such instances lining pressure PC would command valve opening (flow area) and would affect gas flow. Pipe pressure would however no longer affect flow area. Valve would act as a variable aperture governed by the lining.

Figure 7:
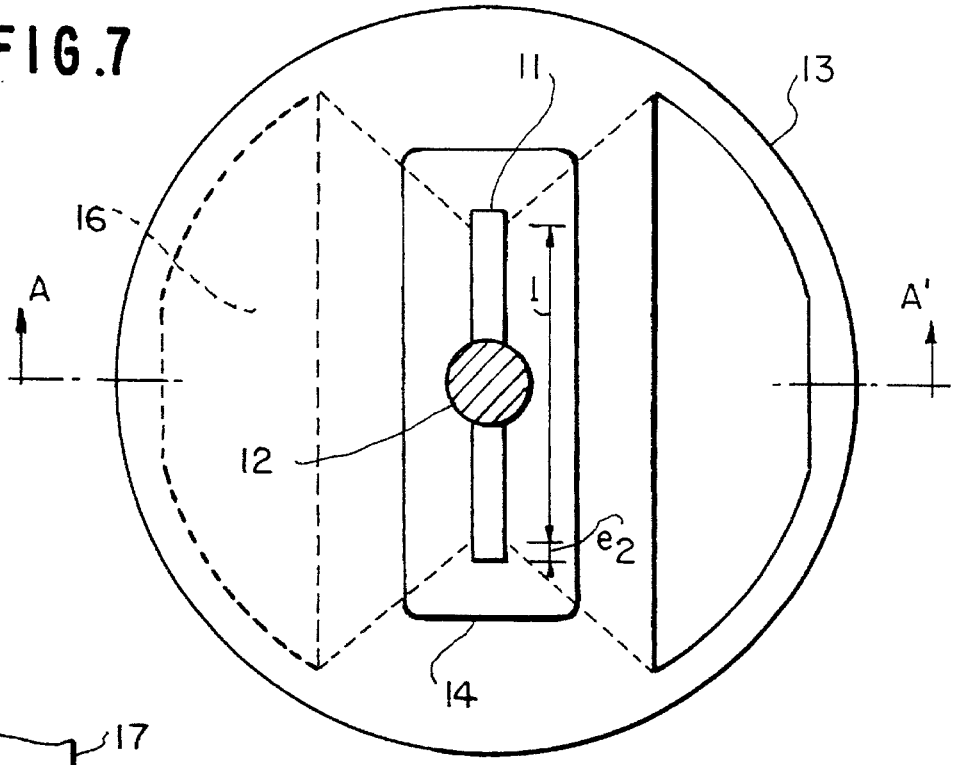
FIG. 7 is a top view of intended valve stem assembly.
Figure 9:
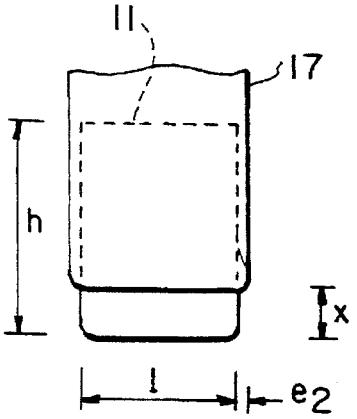
FIG. 9 is a sketch of rectangular seat of valve gate.
Figure 8:
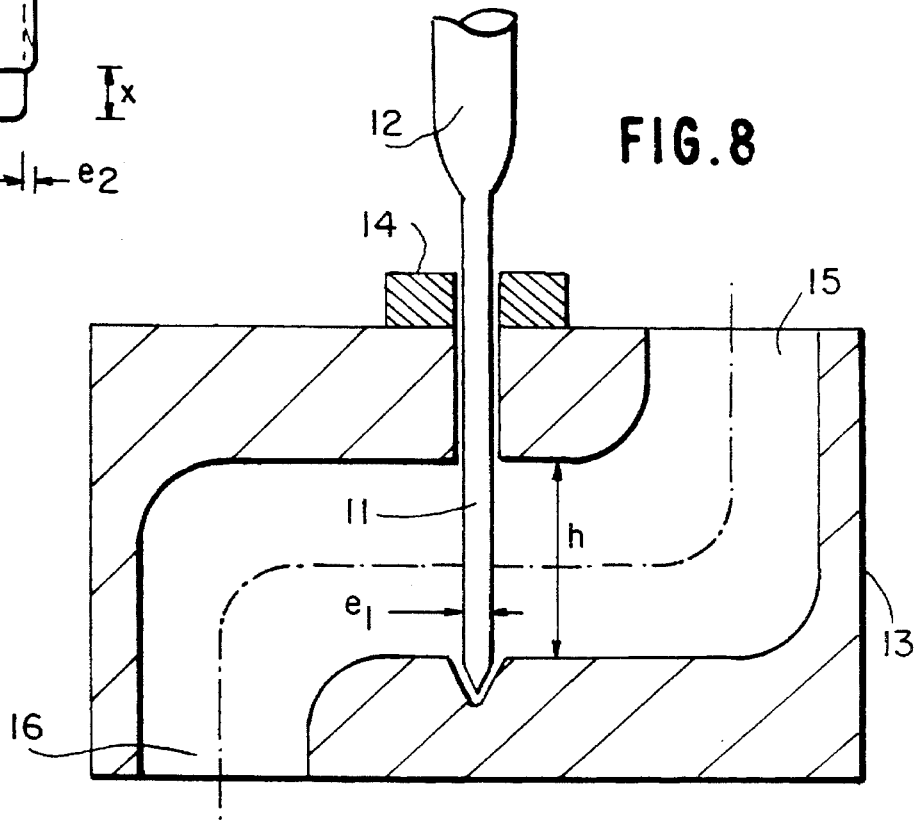
FIG. 8 is a view taken along 88' of FIG. 7.
Figure 10:
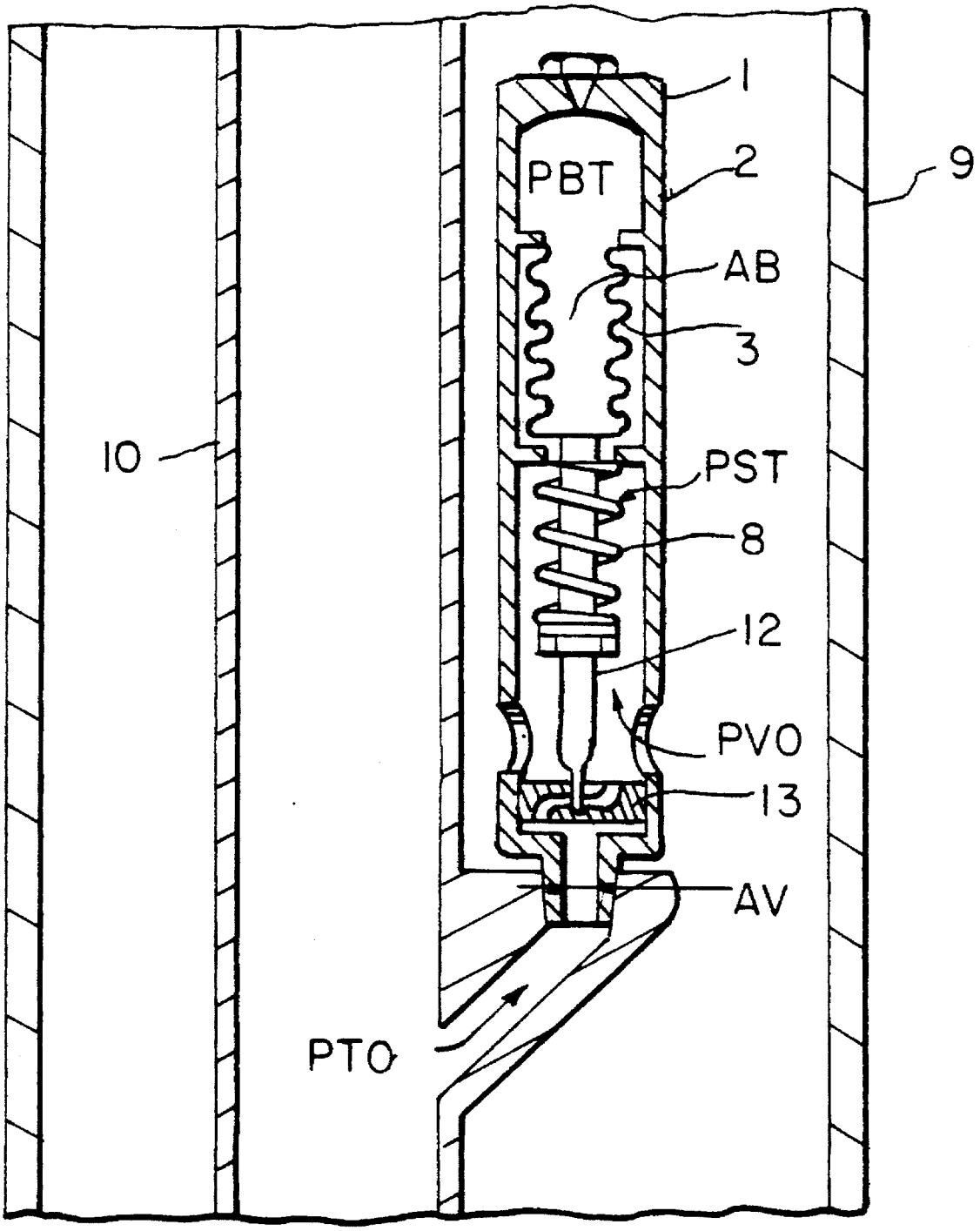
FIG. 10 is a vertical sectional view of the valve assembly according to the present invention.

The improved pressure valve herewith invented, improvements thereto being shown in FIGS. 7, 8, 9 and 10, consists of a new stem-seat assembly for gate, shown in fuller detail in FIGS. 7 and 8, where gate valve member 11 is a flat plate-like member having a rectangular configuration and at its top has a stem 12 which gate valve member 11/stem 12 assembly lying in the middle of valve seat 13 and next to upper seals 14, gate valve member 11 travelling upwards and downwards, both releasing and blocking flow of gas through incoming 15 and outgoing 16 gas ports, through valve seat body 13, seat 17 of gate valve member 11 being shown in fuller detail in FIG. 9, and being rectangular in cross-section. FIG. 10 shows the entire valve assembly similar to that of FIG. 3 but with new gate valve assembly of FIGS. 7–9 in lieu of the stem 4 and seal 6 of the prior art.

Thus, valve opening will depend only upon lining pressure and, once open, pressure $P^{++}$ acting upon lower end of gate valve member 11 will act upon an area which is a lot less in size than before (current valve).

In the valve formerly used, as we have seen, pipe pressure PT or flow pressure $P^{++}$ act upon an area $$AV = \frac{\pi}{4} d^2$$

where d is diameter of seat (gate) 6. Lining pressure acts upon area $$(AB - AV) = AB - \frac{\pi}{4} d^2.$$

Ratio R=AV/AB defines the influence degree pipe pressure PT (or flow pressure $P^{++}$) upon the opening or operation of valve.

For improved pressure valve herewith invented pressures PT and $P^{++}$ act upon an area (see FIGS. 7 and 8) $AV' = (L + 2e_2) \cdot e_1$ and lining pressure upon an area AB–AV, which leads to a fresh ratio: R'=AV'/AB, for valve invented. Since seat areas must be the same, then $$\frac{\pi}{4} d^2 = LH.$$

Then:

$$\gamma = \frac{AV'/AB}{AV/AB} = \frac{AV'}{AV} = \frac{(L + 2e_2) \cdot e_1}{\pi d^2/4} = \frac{(L + 2e_2) \cdot e_1}{Lh} =$$

$$= \frac{1}{h} \left( 1 + \frac{2e_2}{L} \right) \cdot e_1$$

The ratio γ for reducing the effect of PT or $P^{++}$ pressures is a function of h (height of rectangular seat), of $e_1$ (thickness of gate) and of $e_2$ (clearance sealing through which gate runs), since L is a function of h, for the pair PC, PT define the area of seat 17 which is a preset figure. Height h is in turn a function of maximum travel of stem 12.

As an example, let us take $$h = d,\ e_1 = \frac{L}{8},\ e_2 = \frac{L}{10},$$

$$\text{then } \frac{\pi d^2}{4} = Lh = Ld \text{ or } L = \frac{\pi^d}{4}:$$

$$\gamma = \frac{1}{d} \cdot \left( 1 + \frac{2 \cdot L/10}{L} \right) \cdot \frac{L}{8} = \frac{3}{20} \cdot \frac{L}{d} =$$

$$\frac{3}{20} \cdot \frac{\pi}{4} = \frac{3\pi}{80} \cong 0{,}12$$

R would become about 12% of what it was with the previous stem-seat shape. This would mean a drop in the effect of the pipe from about 7% to about 25% of the range of present valves, to about 1% and 3% only, so that the valve will really become "lining operated".

Figures arrived at are just examples. With this improved pressure valve control is made easier since the pressure that acts in the pipe (whether directly or indirectly by $P^{++}$) practically does not affect the degree valve opening. Any instabilities as regards part openings will also be eliminated. It should be pointed out that in the above explanation no regard was had for friction of gate valve member 11 upon its seat 17.

It should also be mentioned that though the shape of gate valve member 11 used for the improved pressure valve herewith invented is preferable rectangular, other shapes may apply, such as elliptical or circular.

I claim:

1. A pressure valve assembly for use in gas-lift producing oil wells comprising a cylindrical body, a first pressure chamber including bellows located in said body, a second pressure chamber in said body having a first port for communication with gas pressure in a lining, a second port for communicating said second chamber with a pipe in the lining, a valve stem connected to said bellows for movement in said second chamber and a gate valve assembly in said second chamber connected to said stem for controlling gas flow between said first and second ports, wherein said gate valve assembly is comprised of a valve seat body having a gas passage extending therethrough and a flat plate-like gate valve member connected to said valve stem for movement through said body transversely of said passage.

2. A pressure valve assembly as set forth in claim 1, wherein said gate valve member has a rectangular configuration.

* * * * *